US005385024A

United States Patent [19]

Roberts et al.

[11] Patent Number: 5,385,024

[45] Date of Patent: Jan. 31, 1995

[54] CRYOGENIC RECTIFICATION SYSTEM WITH IMPROVED RECOVERY

[75] Inventors: Mark J. Roberts, Grand Island; Harry Cheung, Williamsville, both of N.Y.

[73] Assignee: Praxair Technology, Inc., Danbury, Conn.

[21] Appl. No.: 128,177

[22] Filed: Sep. 29, 1993

[51] Int. Cl.[6] ..... F25J 3/02

[52] U.S. Cl. ..... 62/25; 62/29; 62/39

[58] Field of Search ..... 62/25, 24, 29, 39

[56] References Cited

U.S. PATENT DOCUMENTS

| | | | |
|---|---|---|---|
| 3,327,489 | 6/1967 | Gaumer, Jr. | 62/29 |
| 3,707,849 | 1/1973 | Becker | 62/29 |
| 4,222,756 | 9/1980 | Thorogood | 62/13 |
| 4,261,719 | 4/1981 | Gotoh et al. | 62/29 |
| 4,400,188 | 8/1983 | Patel et al. | 62/13 |
| 4,410,343 | 10/1983 | Ziemer | 62/29 |
| 4,526,595 | 7/1985 | McNeil | 62/28 |
| 4,533,375 | 8/1985 | Erickson | 62/22 |
| 4,594,085 | 6/1986 | Cheung | 62/25 |
| 4,595,405 | 6/1986 | Agrawal et al. | 62/18 |
| 4,604,117 | 8/1986 | Cheung | 62/25 |
| 4,705,548 | 11/1987 | Agrawal et al. | 62/22 |
| 4,848,996 | 7/1989 | Thorogood et al. | 62/39 |
| 4,902,321 | 2/1990 | Cheung | 62/24 |
| 4,966,002 | 10/1990 | Parker et al. | 62/31 |
| 5,037,462 | 8/1991 | Schweigert | 62/24 |
| 5,098,457 | 3/1992 | Cheung et al. | 62/24 |
| 5,222,365 | 6/1993 | Nenov | 62/39 |
| 5,287,704 | 2/1994 | Rathbone | 62/25 |

OTHER PUBLICATIONS

Agrawal et al., Production of Medium Pressure Nitrogen By Cyrogenic Air Separation, Gas Separation And Purification, Dec. 1991, 203–209.

*Primary Examiner*—Ronald C. Capossela
*Attorney, Agent, or Firm*—Stanley Ktorides

[57] ABSTRACT

A cryogenic rectification system wherein nonproduct fluid from a cryogenic rectification plant is compressed and mixed with incoming feed at an intermediate temperature, and the resulting mixture passed into the cryogenic rectification plant enabling production of product with improved recovery especially at elevated pressure.

8 Claims, 1 Drawing Sheet

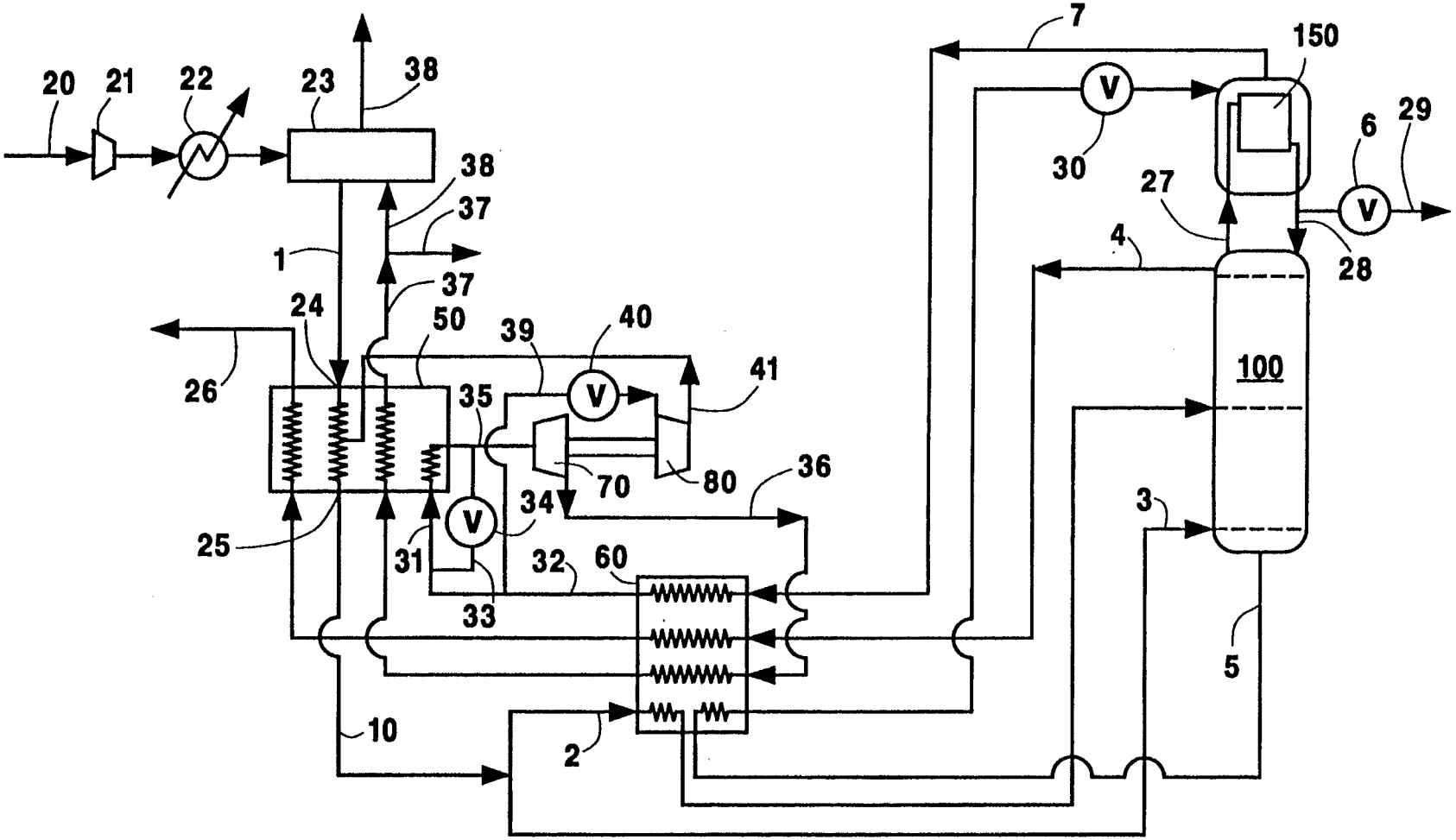
29
6
28
150
100
5
27
3
4
7
30
36
41
80
40
70
60
2
39
34
32
35
33
38
37
37
50
31
38
10
23
24
1
25
26
22
21
20

CRYOGENIC RECTIFICATION SYSTEM WITH IMPROVED RECOVERY

TECHNICAL FIELD

This invention relates generally to cryogenic rectification and is particularly useful for the production of nitrogen at pressures greater than about 80 pounds per square inch absolute (psia).

BACKGROUND ART

The production of nitrogen by the cryogenic rectification of feed air is a well established commercial process. Typically, nitrogen is produced by rectification of the feed air in a single column cryogenic rectification plant wherein a portion of the waste fluid is turboexpanded to generate refrigeration to drive the separation. The portion of the waste fluid which is not turboexpanded constitutes an inherent thermodynamic irreversibility and thus a source of inefficiency.

Nitrogen demand is increasing especially for such uses as blanketing and inerting in the metalworking and electronics industry and for nitrogenation in the chemical industry. Accordingly it is desirable to improve the nitrogen recovery which is attainable with the conventional cryogenic rectification system. This is particularly the case where nitrogen product is desired at an elevated pressure such as at a pressure greater than about 80 psia since it is known that cryogenic rectification is more difficult at higher pressures due to the reduced relative volatilities of the components to be separated.

Accordingly, it is an object of this invention to provide a cryogenic rectification system whereby nitrogen may be produced with an improved recovery over that attainable with conventional systems.

SUMMARY OF THE INVENTION

The above and other objects which will become apparent to one skilled in the art upon a reading of this disclosure are attained by the present invention, one aspect of which is:

A cryogenic rectification method for the production of nitrogen comprising:

(A) cooling feed air from a first temperature to a second temperature;

(B) passing cooled feed air into a cryogenic rectification plant and producing nitrogen-enriched fluid and oxygen-enriched fluid within the cryogenic rectification plant;

(C) withdrawing oxygen-enriched fluid from the cryogenic rectification plant, compressing the withdrawn oxygen-enriched fluid, and combining the compressed oxygen-enriched fluid with feed air at a point where the feed air is at a temperature between said first and second temperatures;

(D) passing oxygen-enriched fluid into the cryogenic rectification plant with the feed air; and (E) recovering nitrogen-enriched fluid from the cryogenic rectification plant as product nitrogen.

Another aspect of the invention is:

A cryogenic rectification apparatus comprising:

(A) a cryogenic rectification plant;

(B) means for passing feed into the cryogenic rectification plant, said feed passing means including cooling means having an inlet where the feed is at a first temperature and an outlet where the feed is at a second temperature;

(C) a compressor and means for passing fluid from the cryogenic rectification plant to the compressor;

(D) means for passing fluid from the compressor into the feed passing means at a point between said inlet and said outlet; and (E) means for recovering fluid from the cryogenic rectification plant.

As used herein, the term "feed air" means a mixture comprising primarily nitrogen and oxygen, such as air.

As used herein, the terms "turboexpansion" and "turboexpander" mean respectively method and apparatus for the flow of high pressure gas through a turbine to reduce the pressure and the temperature of the gas thereby generating refrigeration.

As used herein, the term "column" means a distillation or fractionation column or zone, i.e. a contacting column or zone wherein liquid and vapor phases are countercurrently contacted to effect separation of a fluid mixture, as for example, by contacting or the vapor and liquid phases on a series of vertically spaced trays or plates mounted within the column and/or on packing elements which may be structured packing and/or random packing elements. For a further discussion of distillation columns, see the Chemical Engineers' Handbook fifth edition, edited by R. H. Perry and C. H. Chilton, McGraw-Hill Book Company, New York, Section 13, *The Continuous Distillation Process.*

Vapor and liquid contacting separation processes depend on the difference in vapor pressures for the components. The high vapor pressure (or more volatile or low boiling) component will tend to concentrate in the vapor phase whereas the low vapor pressure (or less volatile or high boiling) component will tend to concentrate in the liquid phase. Partial condensation is the separation process whereby cooling of a vapor mixture can be used to concentrate the volatile component(s) in the vapor phase and thereby the less volatile component(s) in the liquid phase. Rectification, or continuous distillation, is the separation process that combines successive partial vaporizations and condensations as obtained by a countercurrent treatment of the vapor and liquid phases. The countercurrent contacting of the vapor and liquid phases is adiabatic and can include integral or differential contact between the phases. Separation process arrangements that utilize the principles of rectification to separate mixtures are often interchangeably termed rectification columns, distillation columns, or fractionation columns. Cryogenic rectification is a rectification process carried out at least in part at temperatures at or below 150 degrees Kelvin (K.).

As used herein, the term "indirect heat exchange" means the bringing of two fluid streams into heat exchange relation without any physical contact or intermixing of the fluids with each other.

As used herein, the term "cryogenic rectification plant" means an apparatus comprising at least one column.

As used herein, the terms "compression and compressor" mean respectively method and apparatus for increasing the pressure of a gaseous stream using work input provided from an external source.

As used herein, the term "top condenser" means a heat exchange device which generates column downflow liquid from column top vapor.

BRIEF DESCRIPTION OF THE DRAWING

The sole FIGURE is a simplified schematic representation of one preferred embodiment of the cryogenic rectification system of this invention.

DETAILED DESCRIPTION

The invention will be described in detail with reference to the FIGURE which illustrates one preferred embodiment of the invention wherein feed air is rectified to produce nitrogen in a cryogenic rectification plant having a single column and wherein a portion of the waste is turboexpanded to generate refrigeration.

Referring now to the FIGURE, feed air 20 is compressed by passage through compressor 21 generally to a pressure within the range of from 80 to 300 psia. The compressed feed air is then passed through cooler 22 to remove heat of compression and then passed through prepurifier 23 wherein it is substantially cleaned of high boiling impurities such as water vapor and carbon dioxide. In the embodiment illustrated in the FIGURE, the prepurifier is a molecular sieve adsorption type prepurifier.

The feed air is cooled, such as by indirect heat exchange with one or more return streams, from a first temperature to a second temperature. Generally, the first temperature is within the range of from 260 to 320 K. and the second temperature is within the range of from 90 to 120 K. In the embodiment illustrated in the FIGURE cleaned, cooled feed air 1 is cooled from the first temperature to the second temperature by passage through a cooling means which comprises primary heat exchanger 50 having an inlet at 24 and an outlet at 25. The feed air is at the first temperature at the inlet and is at the second temperature at the outlet. Generally, the second temperature is at least 150 K. and preferably is at least 165 K. cooler than the first temperature. In the embodiment illustrated in the FIGURE, the cooling means having the inlet and outlet through which the feed air is cooled from the first temperature to the second temperature is shown as a single piece of equipment. Those skilled in the art will recognize that this cooling means can comprise two or more separate pieces of equipment with interconnecting conduits.

The cooled feed air 10 is then passed into the cryogenic rectification plant. The cooled feed air 10 also comprises oxygen-enriched fluid which has been passed into the feed air as will be more fully described later. In the embodiment illustrated in the FIGURE, stream 10 is divided into two streams 2 and 3. Stream 3 is passed into the lower portion of column 100 and stream 2 is condensed by indirect heat exchange with return streams in heat exchanger 60 and passed into column 100 at a point at least one equilibrium stage above the point where stream 3 is passed into column 100.

In the embodiment of the invention illustrated in the FIGURE the cryogenic rectification plant comprises column 100 and top condenser 150. Column 100 is operating at a pressure generally within the range of from 80 to 300 psia. Within column 100, the fluids fed into the column are separated by cryogenic rectification into nitrogen-enriched fluid and oxygen-enriched fluid. The nitrogen-enriched fluid has a nitrogen concentration which exceeds that of the feed air and generally has a nitrogen concentration of at least 95 mole percent. The oxygen-enriched fluid has an oxygen concentration which exceeds that of the feed air and generally is within the range of from 35 to 60 mole percent.

A first portion of the nitrogen-enriched fluid is withdrawn from column 100 as vapor stream 4, warmed by passage through heat exchangers 60 and 50 and recovered as nitrogen gas product 26. The practice of this invention is particularly advantageous when the product nitrogen is produced at an elevated pressure such as at a pressure greater than about 80 psia. This is because the flowrate of the oxygen-enriched fluid which can be recycled increases with increasing pressure. The recycled flow combined with feed air at the intermediate temperature enables attainment of higher nitrogen recovery than can be attained with conventional systems.

A second portion 27 of nitrogen-enriched fluid is passed as vapor into top condenser 150 wherein it is condensed by indirect heat exchange with oxygen-enriched liquid. Resulting nitrogen-enriched liquid 28 is passed into column 100 as reflux. If desired, a portion 29 of nitrogen-enriched liquid 28 may be passed through valve 6 and recovered as liquid nitrogen product.

Oxygen-enriched fluid is passed out of column 100 as liquid stream 5, supercooled by passage through heat exchanger 60 and passed through valve 30 into top condenser 150 wherein it is vaporized by indirect heat exchange with the aforedescribed condensing nitrogen-enriched vapor. Resulting oxygen-enriched vapor is withdrawn from top condenser 150 of the cryogenic rectification plant in line 7 and warmed by passage through heat exchanger 60. A portion 31 of resulting warmed stream 32 is warmed by partial traverse of heat exchanger 50, and another portion 33 is passed through valve 34 without passing through heat exchanger 50. Portions 31 and 33 are combined to form stream 35 which is turboexpanded by passage through turboexpander 70 to generate refrigeration. Resulting turboexpanded stream 36 is warmed by passage through heat exchangers 60 and 50 wherein refrigeration within stream 36 is passed by indirect heat exchange into the incoming streams for passage into the cryogenic rectification plant. Resulting stream 37 is removed from the system as waste. If desired, a portion 38 of the waste stream may be used as regeneration fluid for prepurifier 23 as illustrated in the FIGURE.

A portion 39 of stream 32 is passed through valve 40 and is compressed by passage through compressor 80, generally by at least 50 psia to a pressure generally within the range of from 80 to 300 psia. Preferably, as illustrated in the FIGURE, compressor 80 is coupled to turboexpander 70 so that the operation of turboexpander 70 serves to drive compressor 80 without need for any intervening generator. Compressed oxygen-enriched fluid is then passed out of compressor 80 as stream 41 and is combined with the feed air at a point between the inlet and the outlet or where the feed air temperature is between the first and second temperatures. Preferably, the compressed oxygen-enriched fluid will be combined with the feed air at a point where the feed air is at a temperature which exceeds the second temperature by from 15 to 60 percent of the temperature difference between the first and second temperatures. The oxygen-enriched stream is compressed because it is at a lower pressure than the column to which the combined stream is fed. The mixing of the oxygen-enriched fluid with feed air is accomplished at an intermediate temperature preferably approximately equal to the temperature of the oxygen-enriched fluid as this minimizes the thermodynamic irreversibility of the mixing process.

The following example is presented for illustrative purposes and is not intended to be limiting. A computer simulation of the invention was carried out with air as the feed and with an embodiment similar to that illustrated in the FIGURE except there was no liquid nitrogen recovery and cooled feed stream 10 was passed directly into column 100 as stream 3 and stream 2 was eliminated. The results of this computer simulation are presented in Table 1. The stream numbers reported in Table 1 correspond to those of the FIGURE.

TABLE 1

| Stream No. | Flowrate (ft 3/hr.) | Pressure (psia) | Temp (K) | Composition (mole percent) N2 | O2 | Ar |
|---|---|---|---|---|---|---|
| 1 | 279,000 | 126.5 | 282.0 | 78.11 | 20.96 | 0.93 |
| 3 | 383,000 | 124.5 | 107.7 | 71.21 | 27.56 | 1.23 |
| 4 | 150,000 | 120.0 | 100.8 | 99.999 | 1 ppb | 5.7 ppm |
| 5 | 233,000 | 124.5 | 106.9 | 52.71 | 45.27 | 2.02 |
| 7 | 233,000 | 56.6 | 99.3 | 52.71 | 45.27 | 2.02 |
| 39 | 104,000 | 56.6 | 104.1 | 52.71 | 45.27 | 2.02 |
| 41 | 104,000 | 124.6 | 136.1 | 52.71 | 45.27 | 2.02 |

In this example, the feed air first temperature at the inlet is 282.0 K. and the feed air second temperature at the outlet is 107.7 K. The oxygen-enriched fluid was mixed with the feed air at a point where the feed air temperature is 136 K. Nitrogen gas is recovered as product at a purity of 99.9994 mole percent and a pressure of 120 psia at a flowrate of 150,000 cubic feet per hour NTP (normal temperature and pressure). This represents a recovery of 53.7 percent of the nitrogen in the feed.

In comparison, when a comparable conventional single column cryogenic rectification system with waste turboexpansion is carried out, the nitrogen recovery is typically less than 40 percent. Thus, with the practice of this invention, one can improve the recovery of nitrogen over that attainable with comparable conventional systems by about 35 percent or more.

Although the invention has been described in detail with reference to a certain preferred embodiment, those skilled in the art will recognize that there are other embodiments of the invention within the spirit and the scope of the claims.

We claim:

1. A cryogenic rectification method for the production of nitrogen comprising:

(A) cooling feed air from a first temperature to a second temperature;

(B) passing cooled feed air into a cryogenic rectification plant and producing nitrogen-enriched fluid and oxygen-enriched fluid within the cryogenic rectification plant;

(C) withdrawing oxygen-enriched fluid from the cryogenic rectification plant, compressing the withdrawn oxygen-enriched fluid, and combining the compressed oxygen-enriched fluid with feed air at a point where the feed air is at a temperature between said first and second temperatures;

(D) passing oxygen-enriched fluid into the cryogenic rectification plant with the feed air; and (E) recovering nitrogen-enriched fluid from the cryogenic rectification plant as product nitrogen.

2. The cryogenic rectification method of claim 1 further comprising turboexpanding a portion of oxygen-enriched fluid which has not undergone the said compression.

3. The cryogenic rectification method of claim 1 wherein the cryogenic rectification plant comprises a single column and a top condenser and the oxygen-enriched fluid withdrawn from the cryogenic rectification plant is withdrawn from the top condenser.

4. The cryogenic rectification method of claim 1 wherein the first temperature is within the range of from 260 K. to 320 K. and the second temperature is within the range of from 90 K. to 120 K., and wherein the compressed oxygen-enriched fluid is combined with feed air where the feed air is at a temperature which exceeds the second temperature by from 15 to 60 percent of the temperature difference between the first and second temperatures.

5. A cryogenic rectification apparatus comprising:

(A) a cryogenic rectification plant;

(B) means for passing feed into the cryogenic rectification plant, said feed passing means including cooling means having an inlet where the feed is at a first temperature and an outlet where the feed is at a second temperature;

(C) a compressor and means for passing fluid from the cryogenic rectification plant to the compressor;

(D) means for passing fluid from the compressor into the feed passing means at a point between said inlet and said outlet; and (E) means for recovering fluid from the cryogenic rectification plant.

6. The cryogenic apparatus of claim 5 further comprising a turboexpander, means for passing fluid from the cryogenic rectification plant to the turboexpander, and means for passing fluid from the turboexpander to the cooling means.

7. The cryogenic rectification apparatus of claim 6 wherein the turboexpander is coupled to the compressor.

8. The cryogenic rectification apparatus of claim 5 wherein the cryogenic rectification plant comprises a single column and a top condenser and wherein the means for passing fluid from the cryogenic rectification plant to the compressor communicates with the top condenser.

* * * * *

UNITED STATES PATENT AND TRADEMARK OFFICE

CERTIFICATE OF CORRECTION

PATENT NO. : 5,385,024

DATED : January 31, 1995

INVENTOR(S) : M.J. Roberts etal

It is certified that error appears in the above-identified patent and that said Letters Patent is hereby corrected as shown below:

On the title page, item [54], and col. 1:

In the title between "IMPROVED" and "RECOVERY" insert

-- NITROGEN--.

Signed and Sealed this

Twenty-eight Day of March, 1995

*Attest:*

Bruce Lehman

BRUCE LEHMAN

*Attesting Officer*

*Commissioner of Patents and Trademarks*